US010923259B2

(12) United States Patent
Jung et al.

(10) Patent No.: US 10,923,259 B2
(45) Date of Patent: Feb. 16, 2021

(54) COIL COMPONENT

(71) Applicant: SAMSUNG ELECTRO-MECHANICS CO., LTD., Suwon-si (KR)

(72) Inventors: Min Ki Jung, Suwon-si (KR); Su Bong Jang, Suwon-si (KR); Sang Jong Lee, Suwon-si (KR)

(73) Assignee: SAMSUNG ELECTRO-MECHANICS CO., LTD., Suwon-si (KR)

( * ) Notice: Subject to any disclaimer, the term of this patent is extended or adjusted under 35 U.S.C. 154(b) by 261 days.

(21) Appl. No.: 15/493,564

(22) Filed: Apr. 21, 2017

(65) Prior Publication Data

US 2018/0012697 A1 Jan. 11, 2018

(30) Foreign Application Priority Data

Jul. 7, 2016 (KR) ..... 10-2016-0085964
Jul. 28, 2016 (KR) ..... 10-2016-0096178

(51) Int. Cl.

| | |
|---|---|
| ***H01F 27/29*** | (2006.01) |
| ***H01F 1/36*** | (2006.01) |
| ***H01F 17/00*** | (2006.01) |
| *H01F 5/00* | (2006.01) |

(52) U.S. Cl.

CPC ..... *H01F 1/36* (2013.01); *H01F 17/0013* (2013.01); *H01F 27/292* (2013.01); *H01F 2017/0073* (2013.01)

(58) Field of Classification Search

CPC ..... H01F 27/2804; H01F 41/061; H01F 27/2823; H01F 27/28
USPC ..... 336/192, 200, 223
See application file for complete search history.

(56) References Cited

U.S. PATENT DOCUMENTS 4,313,152 A * 1/1982 Vranken ..... H01F 5/003 336/200
5,251,108 A * 10/1993 Doshita ..... H01F 17/0013 336/200
5,274,904 A * 1/1994 Proise ..... B60L 13/04 156/226
5,302,932 A * 4/1994 Person ..... H01F 17/0013 336/200
5,392,019 A * 2/1995 Ohkubo ..... H01F 27/36 336/200
6,124,779 A * 9/2000 Yamamoto ..... H01F 17/0013 29/604
6,150,915 A * 11/2000 O'Reilly ..... H01F 17/0013 336/200

(Continued)

FOREIGN PATENT DOCUMENTS

| | | |
|---|---|---|
| JP | 6-60114 U | 8/1994 |
| JP | 2004-200406 A | 7/2004 |
| KR | 10-0899561 B1 | 5/2009 |

*Primary Examiner* — Alexander Talpalatski
*Assistant Examiner* — Joselito S. Baisa
(74) *Attorney, Agent, or Firm* — Morgan, Lewis & Bockius LLP

(57) ABSTRACT

A coil component includes a body, a coil disposed inside of the body and forming one coil track when being viewed in a laminated direction, external electrodes disposed on an outer surface of the body. The coil track includes corner portions and linear portions connecting the respective corner portions to each other, and a line width of the corner portion is greater than that of the linear portion.

9 Claims, 2 Drawing Sheets

(56) References Cited

U.S. PATENT DOCUMENTS 6,154,111 A * 11/2000 Rehm ..... H01F 17/0013 336/178
6,541,968 B1 * 4/2003 Tokuda ..... G01R 33/028 324/258
6,549,112 B1 * 4/2003 Gallina ..... H01F 5/003 336/200
7,046,113 B1 * 5/2006 Okamoto ..... H01F 17/0006 336/200
7,327,207 B2 * 2/2008 Asakawa ..... H01F 17/0013 333/175
7,375,977 B2 * 5/2008 Maeda ..... H01F 17/0013 336/200
7,694,414 B2 * 4/2010 Maeda ..... H01F 17/0013 29/832
8,193,894 B2 * 6/2012 Miyoshi ..... H01F 27/34 336/200
8,947,189 B2 * 2/2015 Maruyama ..... H01F 17/0013 29/602.1
9,270,342 B2 * 2/2016 Kasturi ..... H02J 50/12
9,336,938 B2 * 5/2016 Fujii ..... H01F 17/0006
9,536,647 B2 * 1/2017 Hahn ..... H01F 5/003
9,697,946 B2 * 7/2017 Otsubo ..... H01F 17/0013
9,875,837 B2 * 1/2018 Jeong ..... H01F 17/0013
9,941,590 B2 * 4/2018 Luzinski ..... H01Q 5/321
9,966,183 B2 * 5/2018 Yamauchi ..... H01F 27/292
2007/0296536 A1 12/2007 Odahara et al.
2011/0254650 A1 * 10/2011 Banno ..... H01F 17/0013 336/200
2014/0020929 A1 * 1/2014 Hisada ..... H01B 7/0225 174/110 SR
2014/0132385 A1 * 5/2014 Maruyama ..... H01F 17/0013 336/200
2015/0009003 A1 * 1/2015 Ozawa ..... H01F 27/292 336/200
2015/0302983 A1 * 10/2015 Park ..... H02J 50/12 320/108
2016/0042862 A1 * 2/2016 Tachibana ..... H01F 17/0013 336/200
2017/0264143 A1 * 9/2017 Lee ..... H01F 27/255

* cited by examiner

COIL COMPONENT

CROSS-REFERENCE TO RELATED APPLICATION(S)

This application claims benefit of priority to Korean Patent Application Nos. 10-2016-0085964, filed on Jul. 7, 2016 and 10-2016-0096178, filed on Jul. 28, 2016 in the Korean Intellectual Property Office, the disclosure of which is incorporated herein by reference in its entirety.

TECHNICAL FIELD

The present disclosure relates to a coil component that may be miniaturized and have high Q characteristics.

BACKGROUND

An inductor, which is a component of a coil, is a representative passive element or coil component that forms an electronic circuit together with a resistor and a capacitor to remove noise, and is combined with the capacitor, using electromagnetic properties, to configure a resonance circuit amplifying a signal in a specific frequency band, a filter circuit, or the like.

Recently, as miniaturization and thinness of information technology (IT) devices such as various communications devices, display devices, or the like, have been accelerated, research for miniaturizing and thinning various elements such as inductors, capacitors, transistors, and the like, employed in the above-mentioned IT devices has been continuously conducted.

In particular, smartphones recently began using signals of a plurality of frequency bands, due to an application of the LTE multi-band. Accordingly, the coil component is mainly used as an impedance matching circuit in a radio frequency (RF) system for transmitting and receiving a high frequency signal.

As a reduction of a mounting area, caused by the reduction of the overall size of the passive element, such as the inductor for high frequency, and an insufficient mounting space, caused by the addition of additional functions, are gradually increased, the demand for miniaturization and thinness of the passive element is increased.

Therefore, in the coil component, a product that may be miniaturized and have high Q characteristics at the same time is required.

SUMMARY

An aspect of the present disclosure may provide a coil component that may be miniaturized and have high Q characteristics at the same time.

According to an aspect of the present disclosure, a coil component may include a body; a coil disposed inside of the body and forming a coil track; external electrodes disposed on an outer surface of the body. The coil track includes corner portions and linear portions connecting the respective corner portions to each other, and a line width of the corner portion is greater than that of the linear portion.

According to another aspect of the present disclosure, a coil component may include a body; a coil disposed inside of the body and forming a coil track when being viewed in a laminated direction; external electrodes disposed on an outer surface of the body. The coil track includes corner portions and linear portions connecting the respective corner portions to each other, and a radius of a circle tangent to an inside of the corner portion is 0.008 mm to 0.016 mm.

BRIEF DESCRIPTION OF DRAWINGS

The above and other aspects, features and other advantages of the present disclosure will be more clearly understood from the following detailed description taken in conjunction with the accompanying drawings, in which.

DETAILED DESCRIPTION

Hereinafter, exemplary embodiments of the present disclosure will now be described in detail with reference to the accompanying drawings.

Figure 1:
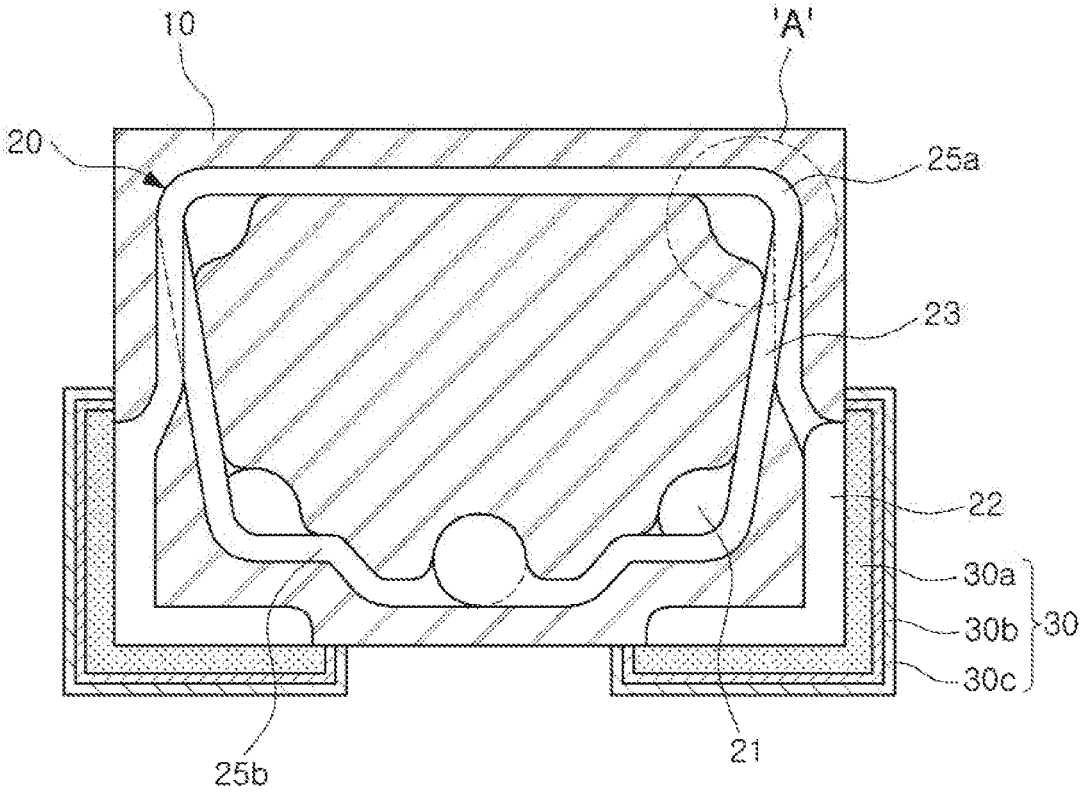
FIG. 1 schematically illustrates a cross-sectional view of a coil component according to an exemplary embodiment in the present disclosure.
Figure 2:
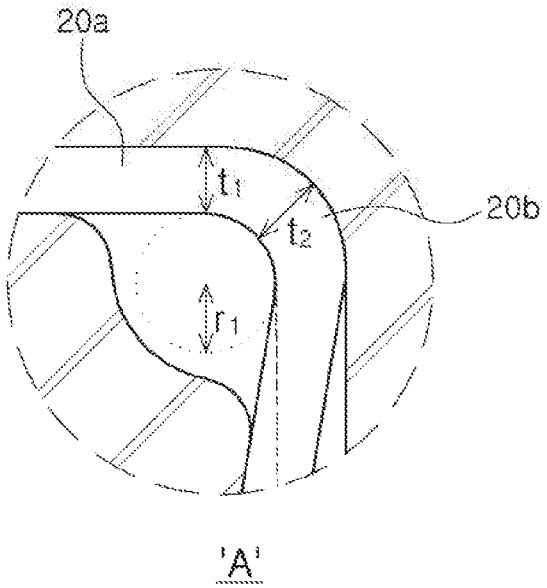
FIG. 2 is an enlarged view of the part A of FIG. 1.

FIG. 1 schematically illustrates a cross-sectional view of a coil component according to an exemplary embodiment in the present disclosure and FIG. 2 is an enlarged view of the part A of FIG. 1.

Referring to FIGS. 1 and 2, a coil component according to an exemplary embodiment in the disclosure may include a body 10 and an external electrode 30.

The body 10 may be formed of a magnetic material, for example, a magnetic ceramic material.

The body 10 may be formed by laminating magnetic ceramic sheets. The magnetic ceramic sheet, which is a sheet in which a ceramic slurry formed of a magnetic powder such as a Cu—Zn based ferrite powder or a Ni—Cu—Zn—Mg based ferrite powder as a main material is molded to a predetermined thickness, may have a coil printed thereon. That is, the body 10 may be formed by alternately laminating the ceramic sheet and a coil pattern.

The external electrode 30 may be disposed on an outer surface of the body 10 to be electrically connected to a lead portion of a coil 20.

In a bottom-mounting case, the external electrode 30 may be disposed on a bottom surface of the body 10.

The external electrode 30 may extend from the bottom surface of the body 10 to an end surface of the body 10 and to wrap around a portion of a corner of the bottom surface of the body 10.

The external electrode 30 may have a first electrode layer 30*a* formed of a conductive paste, and a second electrode layer 30*b* and a third electrode layer 30*c* each formed as a plating layer on the first electrode layer 30*a*.

The second electrode layer 30*b* and the third electrode layer 30*c* may be formed by sequentially plating copper (Cu), nickel (Ni), tin (Sn), or nickel (Ni)-tin (Sn) for solder bonding on a surface.

The coil 20 may be disposed inside the body 10.

The coil 20 may be disposed so that a plurality of coil patterns form a coil track when being viewed in a laminated direction. The respective coil patterns may be electrically connected to each other through a connection portion 21 to form the coil 20 that is wound in a clockwise or an anticlockwise.

That is, the coil patterns on the respective layers may be connected to each other through the connection portion 21 formed at a predetermined position of the magnetic ceramic sheet to form one coil that is spirally wound. That is, the coil patterns of the respective layers may be printed on the respective ceramic sheets in a form in which one coil is divided and plated.

The lead portion 22 may be disposed at both end portions of the coil 20. The lead portion 22 may be electrically connected to the external electrode 30 disposed the outer surface of the body 10.

The coil pattern may be formed of a metal paste, for example, at least one kind metal selected from the group consisting of nickel (Ni), aluminum (Al), iron (Fe), copper (Cu), titanium (Ti), chromium (Cr), gold (Au), silver (Ag), palladium (Pd), and platinum (Pt), or a metal compound thereof on the magnetic ceramic sheet by a screen printing method, or the like.

In the coil component according to the exemplary embodiment, as illustrated in FIG. 1, when the surface on which all of the external electrodes 30 are formed is referred to as a mounting surface, the coil 20 may be disposed to be perpendicular to the mounting surface. The coil 20 being perpendicular to the mounting surface means that coil tracks 23 of the coil 20 are stacked on each other along a direction parallel to the mounting surface.

As described above, when being viewed in the winding direction of the coil 20, one trajectory may be formed and the lead portion 22 may be disposed outside the trajectory.

The lead portion 22 may also be disposed on a layer on which the end portion of the coil 20 is not disposed, in order to improve contact between the external electrode 30 and the body.

In order to improve inductance of the coil component, an internal area of the coil track 23 needs to be increased.

Since the body of a multilayer or thin-film coil component has generally a hexahedral shape, the coil track 23 may have a quadrangular shape to significantly increase the internal area of the coil track 23.

That is, the coil track may include a linear portion 20*a* and a corner portion 20*b*.

The respective linear portions 20*b* are connected to each other by the corner portion 20*b* to form one coil track 23 of the coil 20.

In the case in which the lead portion 22 is disposed outside the trajectory, the coil track 23 may be generally linear only in the vicinity of the lead portion 22 so that the lead portion 22 and the portion forming the coil track 23 are not in contact with each other.

However, the coil component according to the exemplary embodiment may improve the inductance thereof by extending the coil track 23 to a region between the lead portions 22 disposed at both ends of the body 10 in one direction inside the body 10, as illustrated in the coil pattern disposed in a lower end of the coil track 23 of FIG. 1.

That is, in order to extend the coil track 23 to the region between the lead portions 22 disposed at both ends in one direction inside the body 10, the coil track 23 may have an inwardly protruding corner portion.

In this case, a corner portion that outwardly protrudes from the coil track 23 may be referred to as a first corner portion 25*a*, and a corner portion that inwardly protrudes from the coil track 23 may be referred to as a second corner portion 25*b*.

In a case in which the external electrode 30 is formed in a shape of "ㄴ" or "ㄱ" to wrap around the corner of the mounting surface of the body 10, the lead portion 22 may also be formed in the shape of "ㄴ" or "ㄱ" corresponding to the shape of the external electrode 30.

That is, when the lead portion 22 has the shape of "ㄴ" or "ㄱ", the coil track 23 may have the second corner portion 25*b* that inwardly protrudes to correspond to the shape of the shape of "ㄴ" or "ㄱ", and as a result, the coil track 23 may extend between lower straight lines of the shape of "ㄴ" or "ㄱ". Accordingly, the second corner portion 25*b* may be disposed at a position corresponding to the end portion of the lead portion 22. For example, when the lead portion 22 has the shape of "ㄴ" or "ㄱ", the second corner portion 25*b* may be disposed at a position corresponding to an end portion of a horizontal portion of the shape of "ㄴ" or "ㄱ".

In addition, when the lead portion 22 has the shape of "ㄴ" or "ㄱ", a corner portion that outwardly protrudes in a region A, for example, the first corner portion 25*a* may have an inside formed at an acute angle so that the coil track 23 may have a predetermined distance from a vertical portion in the shape of "ㄴ" or "ㄱ". By forming the first corner portion 25*a* at the acute angle, a distance between the lead portion 22 or the external electrode 30 and the coil may be increased to decrease parasitic capacitance.

Since a bending of the coil track 23 generally occurs at the corner portion, current density may be increased at the corner portion of the coil track 23 having the above-mentioned shape.

Therefore, due to a skin effect occurring at the portion in which the current density is increased, resistance R of the coil component may be increased and a current distribution on a surface of the coil component may be non-uniform, which causes loss of Q factor.

In particular, since the first corner portion 25*a* that outwardly protrudes in the region A has the inside formed at the acute angle so that the coil track 23 may have the predetermined distance from the vertical portion of the shape of "ㄴ" or "ㄱ" of the lead portion 22, the current density may be further increased. As a result, due to the skin effect, the resistance R of the coil component is further increased and the current distribution on the surface of the coil component is non-uniform, which may cause the loss of Q factor.

However, since the coil component according to the exemplary embodiment is formed so that the coil 20 includes the corner portions 20*b* at which the coil pattern is bent and the linear portions 20*a* connecting the respective corner portions 20*b* to each other, and a line width $t_2$ of the corner portion 20*b* is greater than a line width $t_1$ of a linear portion 20*a*, the current density may be more uniformly distributed in the corner portions 20*b* and the increase in the resistance of the coil caused by the skin effect may be alleviated. As a result, the Q factor of the coil component may be improved.

For example, the coil 20 may be formed so that $t_2$ is 18 μm when $t_1$ is 14 μm, to improve the Q factor of the coil component.

That is, in order to improve the Q factor of the coil component, a line width $t_2$ of the corner portion 20*b* may be increased by 30 to 40% as compared with a line width $t_1$ of the linear portion 20*a*.

In addition, in order to obtain the same effect described above, the coil pattern may be formed so that a surface area of the corner portion 20*b* is greater than that of the linear portion 20*a*.

Alternatively, in the case in which the coil 20 includes the corner portions 20*b* at which the coil pattern is bent and the linear portions 20*a* connecting the respective corner portions 20*b* to each other, when it is assumed that a circle is tangent to one side of the corner portion 20*b*, a radius $r_1$ of the circle may be 0.008 mm to 0.016 mm.

By assuming a circle tangent to an inside of the coil track 23 in the case of the first corner portion 25*a* and assuming a circle tangent to an outside of the coil track 23 in the case of the second corner portion 25*b*, the radius $r_1$ of the circle may be 0.008 mm to 0.016 mm.

The following Table 1 illustrates L, Q, Rs characteristics for each of the frequencies of the coil component, as data obtained by changing a configuration of the corner portion of the same capacitive model (a line width of the linear portion is 12 μm, parallel). In addition, FIG. 3 schematically illustrates graphs comparing Q factors of the coil component according to an exemplary embodiment and a coil component according to the related art.

Figure 3:
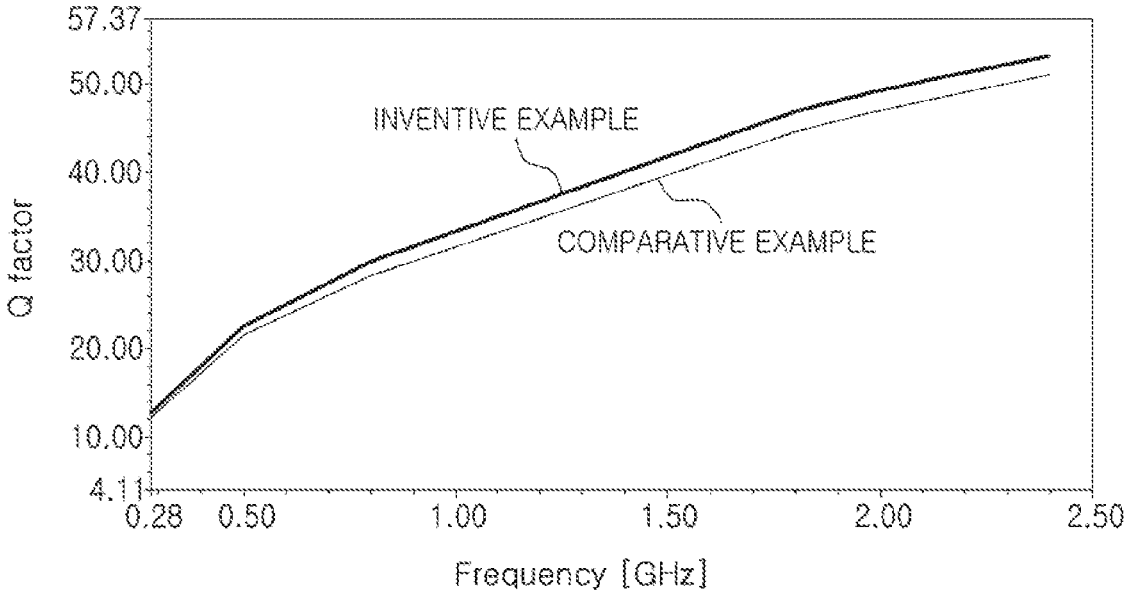
FIG. 3 schematically illustrates graphs comparing Q factors of the coil component according to an exemplary embodiment and a coil component according to the related art.

When it is assumed that a circle is tangent to the inside of the corner portion 20*b*, an Inventive Example of FIG. 3 illustrates a Q value of a case in which a radius of the circle is 0.016 mm ($t_2$: 0.0156 mm) and a Comparative Example thereof illustrates a Q value of a case in which a radius of the circle is 0.01 mm ($t_2$: 0.0115 mm). That is, FIG. 3 illustrates a graph of a case in which the line width of the Inventive Example is increased by 35% as compared with the Comparative Example.

TABLE 1

| | $r_1$ | $t_2$ | L [nH] | | Q | | Rs [Ω] | | |
|---|---|---|---|---|---|---|---|---|---|
| Sample | (mm) | (mm) | 0.5 GHz | 2.4 GHz | 0.5 GHz | 2.4 GHz | 0.5 GHz | 2.4 GHz | 1.0 MHz |
| 1 | 0.006 | 0.0086 | 1.0414 | 1.0360 | 21.9857 | 50.7810 | 0.1488 | 0.3076 | 0.0607 |
| 2 | 0.008 | 0.0088 | 1.0412 | 1.0358 | 21.8873 | 50.9024 | 1.1494 | 0.3069 | 0.0609 |
| 3 | 0.010 | 0.0115 | 1.0381 | 1.0322 | 21.6554 | 51.0818 | 0.1506 | 0.3047 | 0.0598 |
| 4 | 0.012 | 0.0118 | 1.0380 | 1.0330 | 22.1177 | 51.7718 | 0.1474 | 0.3009 | 0.0594 |
| 5 | 0.014 | 0.0126 | 1.0380 | 1.0338 | 22.4118 | 53.3030 | 0.1455 | 0.2980 | 0.0590 |
| 6 | 0.016 | 0.0156 | 1.0364 | 1.0324 | 22.6291 | 53.2023 | 0.1439 | 0.2926 | 0.0577 |
| 7 | 0.018 | 0.0150 | 1.0357 | 1.0307 | 22.1129 | 52.0951 | 0.1471 | 0.2983 | 0.0581 |

In addition, the following Table 2 illustrates a variation of an L value measured at 0.5 GHz, a variation of a Q value measured at 2.4 GHz, a variation of an Rs value measured at 2.4 GHz, and a variation of Rdc, based on a sample 1. However, the variation of Rdc was listed based on the Rs value measured at 1.0 MHz.

TABLE 2

| Sample | $r_1$ (mm) | $t_2$ (mm) | ΔL Variation (%) | ΔQ Variation (%) | ΔRs Variation (%) | ΔRdc Variation (%) |
|---|---|---|---|---|---|---|
| 1 | 0.006 | 0.0086 | 0.00 | 0.00 | 0.00 | 0.00 |
| 2 | 0.008 | 0.0088 | −0.02 | 0.24 | −0.23 | 0.33 |
| 3 | 0.010 | 0.0115 | −0.32 | 0.59 | −0.94 | −1.48 |
| 4 | 0.012 | 0.0118 | −0.33 | 1.95 | −2.18 | −2.14 |
| 5 | 0.014 | 0.0126 | −0.33 | 3.00 | −3.12 | −2.80 |
| 6 | 0.016 | 0.0156 | −0.48 | 4.77 | −4.88 | −4.94 |
| 7 | 0.018 | 0.0150 | −0.55 | 2.59 | −3.02 | −4.28 |

Referring to Tables 1 and 2, a value of the inductance L may be decreased by about 0.5% due to a decrease of a linkage area caused by a change of the line width of the corner portion, but the Q value may be increased by up to 4.77% when the line width is increased by about 30% (Inventive Example 6). However, it may be seen that when the line width is increased to more than 40% (Inventive Example 7), the Q characteristics are decreased.

Therefore, in order to improve the Q factor, the line width $t_2$ of the corner portion 20*b* may be increased by 30 to 40% as compared with the line width $t_1$ of the linear portion 20*a*.

As set forth above, according to the exemplary embodiments in the present disclosure, the coil component may increase the Q factor by preventing the problem that the current is congested at the corner portion of the coil to cause the increase of the resistance because the line width of the corner portion is greater than the line width of the linear portion.

While exemplary embodiments have been shown and described above, it will be apparent to those skilled in the art that modifications and variations could be made without departing from the scope of the present invention as defined by the appended claims.

What is claimed is:

1. A coil component comprising:

a body;

a coil disposed inside of the body and forming one coil track;

external electrodes disposed on an outer surface of the body, wherein the coil track includes a corner portion and linear portions extending from the corner portion, and wherein a radius of a circle tangent to a surface of the corner portion is 0.008 mm to 0.016 mm such that an acute angle is defined between the linear portions.

2. The coil component of claim 1, further comprising another corner portion that inwardly protrudes from the coil track, wherein the corner portion outwardly protrudes from the coil track.

3. The coil component of claim 1, further comprising lead portions disposed outside of the coil track and respectively connecting the external electrodes to corresponding end portions of the coil.

4. The coil component of claim 3, further comprising another corner portion that inwardly protrudes from the coil track, wherein the corner portion outwardly protrudes from the coil track, and the another corner portion is disposed at a position corresponding to an end portion of the lead portion.

5. The coil component of claim 1, further comprising another corner portion that inwardly protrudes from the coil track, wherein the corner portion outwardly protrudes from the coil track.

6. The coil component of claim 1, wherein the coil is disposed to be perpendicular to a mounting surface of the body.

7. The coil component of claim 1, wherein the external electrodes are disposed on a mounting surface of the body.

8. The coil component of claim 1, wherein the coil includes a plurality of coil patterns forming the one coil track, the plurality of coil patterns having respective dielectric layers therebetween and being electrically connected to each other through a connection portion, and wherein the corner portion is devoid of the connection portion.

9. The coil component of claim 1, further comprising another corner portion having an inner edge which is convex.

* * * * *